US009707731B2

(12) United States Patent
Wood

(10) Patent No.: US 9,707,731 B2
(45) Date of Patent: Jul. 18, 2017

(54) MULTI-LAYERED BULK PRODUCT FILLING MATERIAL

(71) Applicant: Brian Wood, Chagrin Falls, OH (US)

(72) Inventor: Brian Wood, Chagrin Falls, OH (US)

(73) Assignee: FIBERCORE, LLC, Cleveland, OH (US)

( * ) Notice: Subject to any disclaimer, the term of this patent is extended or adjusted under 35 U.S.C. 154(b) by 724 days.

(21) Appl. No.: 13/629,743

(22) Filed: Sep. 28, 2012

(65) Prior Publication Data

US 2013/0084448 A1 Apr. 4, 2013

Related U.S. Application Data

(60) Provisional application No. 61/541,172, filed on Sep. 30, 2011.

(51) Int. Cl.
*B31D 5/00* (2017.01)

(52) U.S. Cl.
CPC ..... *B31D 5/006* (2013.01); *B31D 2205/007* (2013.01); *B31D 2205/0058* (2013.01); *Y10T 428/249921* (2015.04)

(58) Field of Classification Search
USPC ..... 428/105, 121, 126, 107–111, 175–186, 428/152–154
See application file for complete search history.

(56) References Cited

U.S. PATENT DOCUMENTS

| | | | | |
|---|---|---|---|---|
| 2,640,794 | A * | 6/1953 | Boysen | B65D 65/44 24/16 R |
| 5,088,972 | A | 2/1992 | Parker | |
| 5,655,479 | A | 8/1997 | Armington et al. | |
| 5,712,020 | A | 1/1998 | Parker | |
| 5,871,432 | A | 2/1999 | Beierlorzer | |
| 5,906,569 | A | 5/1999 | Ratzel | |
| 6,071,574 | A * | 6/2000 | Weder | 428/17 |
| 2008/0115733 | A1 | 5/2008 | Johnes | |
| 2009/0074703 | A1 | 3/2009 | Jewell | |

FOREIGN PATENT DOCUMENTS

| | | |
|---|---|---|
| WO | 91/06694 | 5/1991 |
| WO | 97/05769 | 2/1997 |
| WO | 99/16614 | 4/1999 |
| WO | 99/17923 | 4/1999 |

OTHER PUBLICATIONS

International Search Report and Written Opinion for International Patent Application PCT/US12/57713 dated Dec. 11, 2012.

* cited by examiner

*Primary Examiner* — Lynda Salvatore
(74) *Attorney, Agent, or Firm* — Calfee, Halter & Griswold LLP

(57) ABSTRACT

A filling product comprising a plurality of narrow, elongated strip segments is provided. Each strip segment has a plurality of transverse folds and substantially planar portions between adjacent folds. At least some of the strip segments comprise at least two layers of material, including a first layer comprising a first material and a second layer comprising a second material, wherein the second material is different in composition from the first material. Corresponding methods of producing such filling products are also provided.

8 Claims, 3 Drawing Sheets

MULTI-LAYERED BULK PRODUCT FILLING MATERIAL

The present application claims the benefit of U.S. Provisional Patent Application Ser. No. 61/541,172, filed on Sep. 30, 2011.

The present application relates generally to a multi-layered bulk product filling material. The multi-layered bulk product filling material has various industrial uses, such as for example animal bedding and litter products, dunnage products for protection of items during shipping, void-filling products, and the like. In a particularly useful embodiment, the multi-layered bulk product filing material is used to form animal bedding and litter products. Some of these products are sold under the Eco-Bedding™ brand name.

The objects of the invention are provided by a filling product comprising a plurality of narrow, elongated strip segments which are intertwined and interlocked with each other. Each strip segment comprises a plurality of transverse folds and substantially planar portions between adjacent folds. At least some of the strip segments comprise at least two layers of material, including a first layer comprising a first material and a second layer comprising a second material, wherein the second material is different in composition from the first material.

The present invention also includes a method of producing a filling product. A plurality of narrow, elongated strip segments are provided, with each strip segment comprising a longitudinal length dimension and a transverse width dimension. At least some of the strip segments comprise at least two layers of material, including a first layer comprising a first material and a second layer comprising a second material, wherein the second material is different in composition from the first material. Each strip segment is advanced in a first direction generally parallel with the length dimension, and each strip segment is sequentially folded in on itself during the advancing so that the strip segment forms a plurality of transverse folds and substantially planar portions between adjacent folds.

Numerous advantages and benefits will become apparent to those of ordinary skill in the art upon reading the following detailed description of several embodiments. The invention may take form in various components and arrangements of components, and in various process operations and arrangements of process operations. The drawings are only for the purpose of illustrating many embodiments and are not to be construed as limiting the invention. One should understand the drawings are not necessarily to scale and the elements are sometimes illustrated by schematic, diagrammatic and fragmentary views. In certain instances, the drawings have omitted details which are not necessary for an understanding of the present invention or which render other details difficult to perceive.

FIG. 1 illustrates a portion of a bulk filling product 100 formed by a plurality of narrow, elongated strip segments

Figure 1:
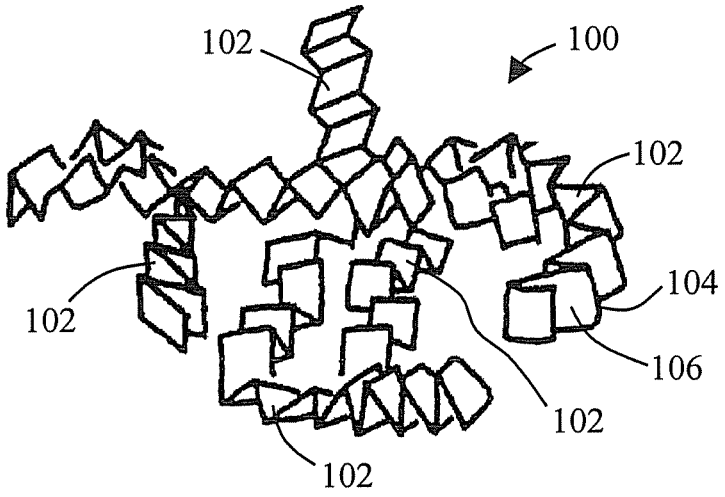
FIG. 1 is a simplified, isometric view of a plurality of folded, interlocking strip segments 102 forming a bulk filling product 100.

102 of a material having a natural resilience. Each of the strip segments 102 has a plurality of transverse folds or crimps such as at 104 against the natural resilience of the strip 102 to form a longitudinally compressed accordion-shaped element 102. Substantially planar portions 106 are formed between adjacent folds 104. The natural resilience of the strip segments 102, combined with the sequential folding, causes the strip segments 102 to be longitudinally compressible and expandable during use.

FIG. 1, for ease of illustration, includes only a very small number of strip segments 102. In actual use, large quantities of strip segments 102 are combined to form the bulk filling product 100. The strip segments 102 intermix, intertwine and interlock with each other to provide an overall resistance and resilience to compression of the bulk filling product 100. The bulk filling product 100 thus provides a shock absorbency, wherein the impact of a blow is dispersed throughout the interacting ridges or webs of the interconnected strip segments 102. The strip segments 102 may all have similar longitudinal lengths and/or transverse widths, or the longitudinal lengths and/or transverse widths of the strip segments 102 may substantially differ.

In one embodiment, each of the strip segments 102 is initially formed in a highly compressed state so that the folds 104 are quite tight and adjacent longitudinal portions 106 lie in near proximity to each other. After that initially compressed state is faulted, however, the natural resiliency of the strip segment 102 material will cause the strip segment 102 to expand longitudinally, so that the fold 104 angles increase and adjacent longitudinal portions 106 separate from each other. As each individual strip segment 102 thereby longitudinally expands, it interacts with nearby strip segments 102 which are simultaneously expanding, to form an interlocking and resilient bulk filling product 100. Each strip segment 102 in the filling product 100 has a natural resilience, a tendency to longitudinally expand, and a tendency to resist lateral or side forces due to the folds 104. Because the ridges of the strip segments 102 interlock with one another, the strip segments 102 hold their form and greatly increase the volume of space they occupy as an intertwined and interlocked mass. Thus, a small amount of material is required to fill a given space, relative to the amount of unfolded material required to fill the same space. The shock absorbency of the bulk filling product 100 is also substantially increased, as the impact of a blow is dispersed throughout each interacting ridge or web of the interconnecting folded strip segments 102.

The strip segments 102 may be manufactured from any convenient material. Pulp materials such as such as paper (including for example 30 pound Kraft paper), cardboard, and the like will often be suitable materials for forming the strip segments 102. Such pulp materials, and other materials, may in some embodiments be recyclable and/or biodegradable to minimize the environmental impact of the filling product 100. Another potentially suitable material for forming the strip segments is Mylar™. The strip segment 102 material may be approved by the U.S. Federal Food and Drug Administration (FDA) for use in packaging edible products, and the material may even itself be edible by animals and/or humans.

Figure 2:
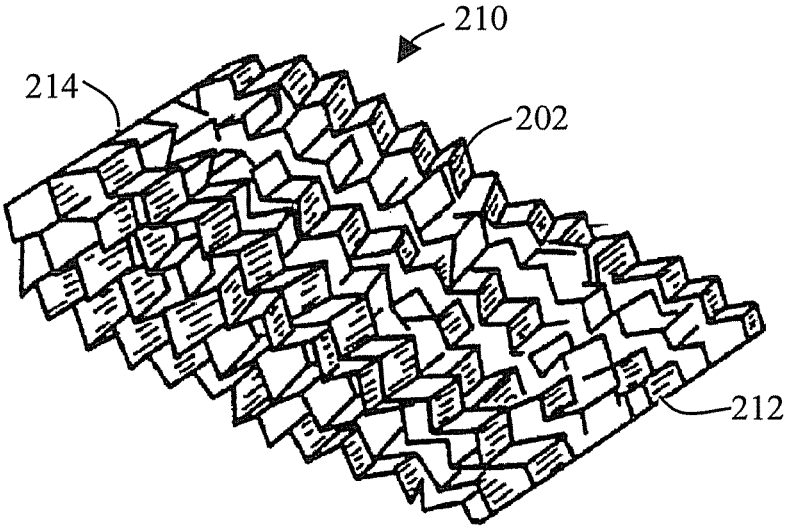
FIG. 2 is a simplified, isometric view of a plurality of folded strip segments 202 which are bonded together to form a grouped element 210.

FIG. 2 illustrates a grouped strip segment element 210 as an alternative embodiment to the free-standing strip segments 102 of FIG. 1. In the grouped element 210, a plurality of elongated and interconnecting strip segments 202 have been folded or crimped. The strip segments 202 of the grouped element 210 are also bonded together at a forward terminal end 212 and a rearward terminal end 214 to form the grouped element 210. A plurality of grouped strip segment elements 210 may be combined to form a bulk filling product 200 (not illustrated).

Figure 3A:
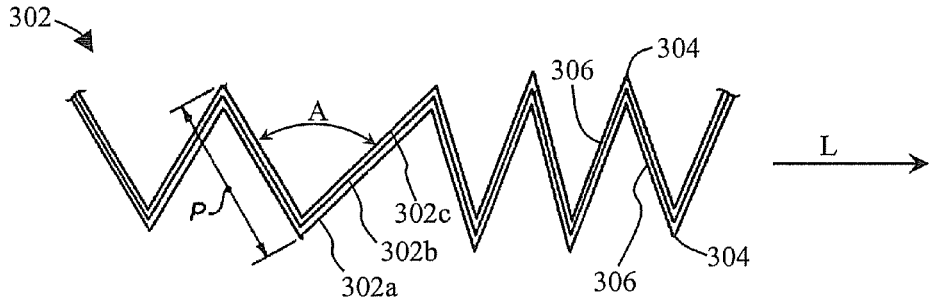
FIG. 3A is a fragmentary side view of a multi-layer strip segment 302.

The strip segments 102 and 202 are each formed of a single layer of material. In alternative embodiments, the strip segments may be composed of more than one layer of material. A representative example a multi-layer strip segment 302 is shown in FIG. 3A, which is a fragmentary side view of a strip segment 302 having three layers 302*a*, 302*b* and 302*c* of material. In additional embodiments (not shown), multi-layer strip segments may include two, or four or more layers of material. The three layers 302*a*-302*c* are shown separated for emphasis but would normally be in close contact throughout the length of the multi-layer strip segment 302. The three layer strip segment 302 includes a plurality of folds 304 with generally planar longitudinal sections 306 between adjacent folds 304. The folds 304 extend substantially transverse to a first, longitudinal direction L of the strip segment 302. One planar section 306 extends in a second direction, generally transverse to the longitudinal direction L, to terminate at a fold 304. The next planar section 306 extends away from that fold 304 in a third direction which is also transverse to the longitudinal direction L and is substantially opposite the second direction of the previous planar section 306. Side resilience and strength are provided by each of the folds 304, and additional side resistance and strength are provided by the inclusion of several layers 302*a*-302*c* in each of the planar sections or portions 306.

FIG. 3A illustrates one representative example of a multi-layer strip segment 302. In that particular example, each one of the planar sections 306 extends approximately the same distance P between two adjacent folds 304. In addition, the angles A formed by each one of the folds 304 vary significantly down the length of the strip segment 302. That particular strip segment 302 is not, by any means, identical to all of the strip segments present in a filling product 300 (not illustrated) made from combining several multi-layer strip segments such as 302. Nevertheless, the multi-layer strip segment 302 is representative and includes typical characteristics of all such strip segments.

Figure 3B:
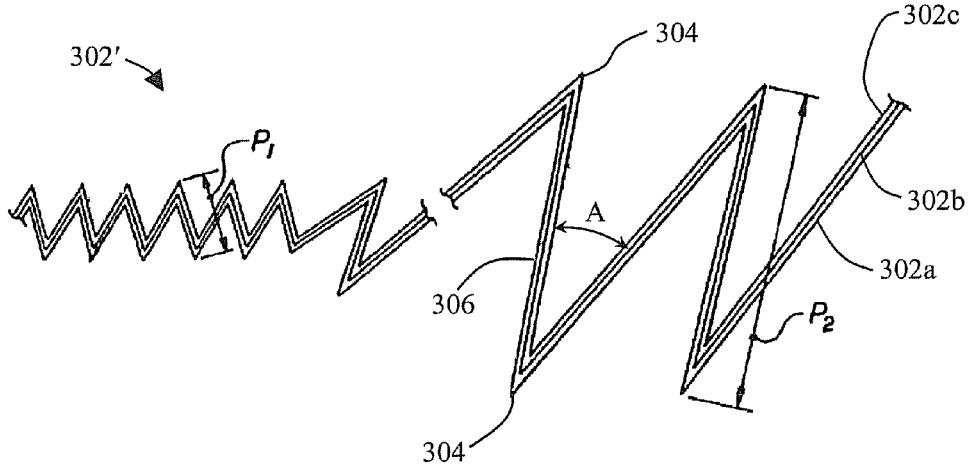
FIG. 3B is a fragmentary side view of an alternative multi-layer strip segment 302'.

The general configuration shown in FIG. 3A is rather schematic and idealized. Because of the tight compaction of the plurality of multi-layer strip segments forming a bulk filling product 300 (not shown), clearly all of the strip segments will not have the preferred generally even length P planar sections 306 shown in FIG. 3A. For example, as seen in FIG. 3B, it is not uncommon for some of the multi-layer strip segments to have a varying configuration of folds 304 and generally planar sections 306 between adjacent folds 304. Thus, FIG. 3B shows a slightly different alternative multi-layer strip segment 302' to the strip segment 302 of FIG. 3A. Many of the features of the alternative strip segment 302' are identical to the features of the strip segment 302 which have already been described above, and they have been labeled by the same reference numerals in the two figures. The principal difference between the two embodiments 302 and 302' is that, while the strip segment 302 includes planar sections 306 of approximately the same length P, the alternative strip segment 302' includes planar sections 306 having several different lengths such as $P_1$ and $P_2$. The shorter lengths such as $P_1$ may be as small as 1/64 of an inch, while the larger lengths such as $P_2$ may be as large as 1 inch. In one particular embodiment, a majority of the planar sections or portions 306 will have a length P of about 1/8 of an inch to about 1/4 of an inch. In another particular embodiment, a majority of the planar sections 306 will have a length of about 1/4 of an inch to about 1/2 of an inch. In yet another embodiment, each strip segment 302 or 302' can have a transverse width dimension perpendicular to the cross-section of FIGS. 3A and 3B, such that a majority of the planar portions 306 have a length dimension which is greater than the segment width dimension, and less than twice the segment width dimension.

While the various strip segments 102, 202, 302 and 302' discussed here have natural resilience and are generally biased along the longitudinal length L thereof, the resistance created by the folds in the strip segments tends to provide significant lateral or side strength to each strip segment as they are intermixed and interconnected throughout the filling product. Further, as the strip segments tend to expand from the initially formed folds having a small angle between the planar sections 306, the partially relaxed angles A of the folds 304 could typically vary from as small as about 5 or 10 degrees to larger angles of about 90 degrees. A very low percentage of individual folds may be completely straightened to about 180 degrees as the various strip segments bend, curve, and intermix together to form the interlocking array of a filling product. In fact, the intermixing and interconnection of all of the various strip segments are so complicated and intertwined that representation in a drawing is virtually impossible.

It has already been known to construct a strip segment having multiple layers, such as the layers 302*a*-302*c*, all of which are composed of the same material. For example, the Eco-Bedding™ product mentioned above comprises strip segments having two layers of material, both composed of the same stiff cardboard paper material. For some uses, however, it is possible that combining two or more layers of materials which are different in composition in one strip segment may be even more beneficial to enhance the functional performance of the strip segment. Thus, the different layers may have differing stiffnesses, to provide an overall stiffness to the strip segment which is beneficial. Or, one of the layers in the strip segment may comprise a material which is particularly good at absorbing liquids, whereas other layers may comprise a different material to provide a suitable rigidity to the strip segments. In yet other embodiments, one or more of the layers in the strip segment may be embedded with a functional agent such as a medicinal product like an anti-pest treatment. In further embodiments, one or more of the layers may include a pH sensitive material, which would indicate when an animal bedding product has been soiled and needs replaced, and/or whether an animal using the bedding product has a urinary infection or other disease. Any two or more of these kinds of layers may be combined in an overall strip segment.

In one particular example, the bottom layer 302*a* of the strip segment 302 may be composed of a relatively stiff cardboard paper. The middle layer 302*b* of the strip segment 302 may be composed of a relatively soft paper. The middle layer 302*b* may be, for example, tissue paper such as a facial tissue or toilet tissue material. And, the top layer 302*c* of the strip segment 302 may be composed of the same relatively stiff cardboard paper used in the bottom layer 302*a*. In this way, the two relatively stiff layers 302*a* and 302*c* provide structural rigidity, while the one relatively soft layer 302*b* helps to provide a cushioning effect as an animal bedding product. Of course, such multi-layered and multi-material strips may have any number of layers and any number of materials within the layers, depending on the application at hand.

Various methods and apparatuses for shredding, folding and crimping sheet stock material into selected lengths of interlocking strip segments are known. Several such methods and apparatuses are provided in U.S. Pat. No. 5,088,972 to Parker; U.S. Pat. No. 5,712,020 to Parker; U.S. Pat. No. 5,871,432 to Beierlorzer; U.S. Pat. No. 5,906,569 to Ratzel; WO 99/17923 to inventors Harding et al. (designating the United States); and WO 99/16614 to inventor Lencoski (designating the United States). Those United States patents and patent applications are hereby incorporated into the present specification by reference both (a) in their entirety and (b) for their specific disclosures concerning methods and apparatuses for manufacturing bulk filling products from strip segments.

Figure 4:
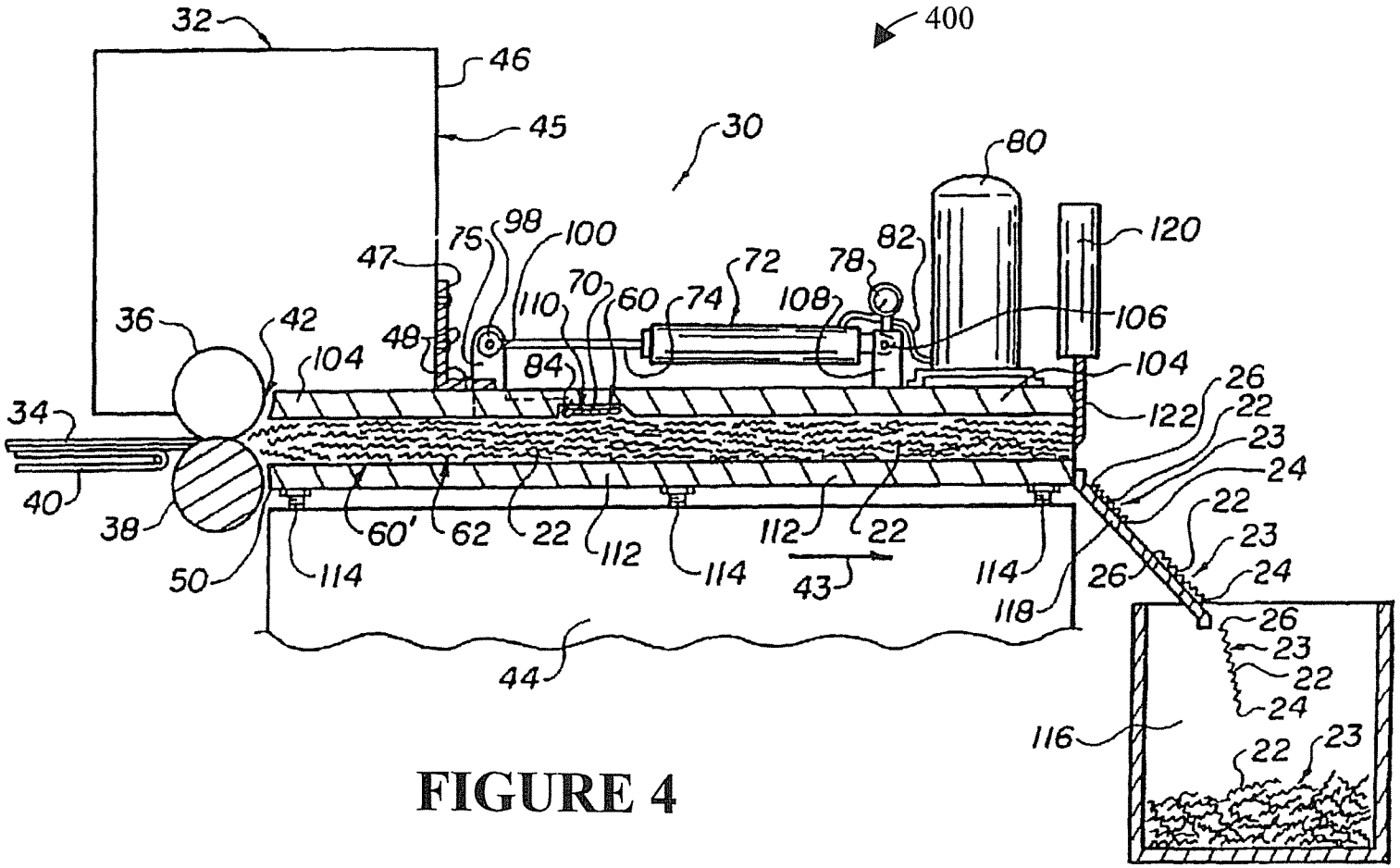
FIG. 4 is a simplified, partial, cross-sectional side elevational view of an apparatus 400 for making strip segments.

One such apparatus 400 is shown in FIG. 4 of the present disclosure, which is identical to FIG. 2 of the Parker '020 patent cited above. The apparatus 400 includes a shredding device 32 and a crimping apparatus 30. Multi-layered sheet stock material 34 is fed into a plurality of rotating cutting blades 36 and 38 which cut the multi-layered sheet stock material 34 into a plurality of strips. The rotation of the cutting blades 36 and 38 expels the strips out through an exit opening 42 of the shredding device 32 and into the crimping apparatus 30, generally at a very rapid rate.

The crimping apparatus 30 has a barrier 60 which may be removably disposed within the path of the moving multi-layered strips. In FIG. 4, the barrier 60 is a pivoting member disposed on a rod 84 so that the barrier 60 may pivot in and out of the path of the moving multi-layered strips. The barrier 60 is shown in its upward and open position in the illustration. When the barrier 60 is moved to its downward and closed position, the multi-layered strips impact or are impelled against the barrier 60 after passing between cutting blades 36 and 38. The barrier 60 causes the multi-layered strips to assume a partially jammed state within a compression chamber or confined area 62 located between the barrier 60 and the cutting blades 36 and 38.

Continued shredding of additional multi-layer stock sheet material 34 by the shredding device 32 forces additional multi-layered strips into the confined area 62, forming a dam of temporarily jammed strips. Once a dam of strips is formed, the front of the dam, which is located most closely to the cutting blades 36 and 38, serves itself as a barrier 60'. As additional multi-layer stock sheet material 34 is fed or pulled into the shredding device 32, the expelling force exerted by cutting blades 36 and 38 forces the multi-layered strips into the confined area 62. As the strips are forced against barriers 60 or 60', the strips are confined within the confined area 62 and are forced to fold against themselves in a relatively controlled manner. Such folding and further insertion of strips into the confined area 62 causes the folded strips to become compacted against themselves and each other, thereby creating multi-layered strip segments 22. As each folded or crimped strip segment 22 is thereby formed into an accordion-shaped element, together the strip segments 22 in the confined area 62 form an extremely packed and tight array. That initial array of multi-layered strip segments basically comprises the end result filling product prior to expansion, relaxation and intermixing. That initial array is so compacted that actual identification of the orientation and configuration of the various multi-layered strip segments 22 is quite difficult. The multi-layered strip segments 22 pass through the confined area 62 and may be deposited with a receiving bin 116, perhaps via a chute or ramp 118.

The multi-layered bulk filling product of the present disclosure has many uses. In one example, the bulk filling product may be made and sold as animal bedding product or for other veterinary purposes. In other representative embodiments, the multi-layered bulk filling product may be used within the wholesale and retail industries as dunnage material. That is, the filling product 100 is placed within a container to position one or more packaged products away from the interior sides of the container and fill empty spaces within the container. In this way, the bulk filling product protects the packaged product(s) against the impact of a blow or other mistreatment. When so used, the packaged product to be protected may be liberally and literally wrapped within multiple lengths of multi-layer strip segments.

The invention has been described with reference to the several embodiments. Obviously, modifications and alterations will occur to others upon reading and understanding the preceding detailed description. It is intended that the invention be construed as including all such modifications and alterations insofar as they come within the scope of the appended claims or the equivalents thereof. It is, therefore, to be understood that the invention is not limited to the particular embodiments or specific features shown herein. The invention may take form in various compositions, components and arrangements, combinations and sub-combinations of the elements of the disclosed embodiments.

Having thus described several embodiments, the invention is now claimed to be:

1. A filling product comprising a plurality of narrow, elongated strip segments which are intertwined and interlocked with each other, each strip segment comprising a plurality of transverse folds and substantially planar portions between adjacent folds, such that at least some of the strip segments comprise at least three layers of material, and the multi-layered strip segments comprise:

a first layer comprising a paper material;

a second layer comprising a paper material; and a third layer disposed between the first layer and the second layer, wherein the third layer comprises a softer material than the paper material of the first layer.

2. The filling product of claim 1, wherein the third layer comprises a tissue paper material.

3. The filling product of claim 2, wherein the first layer is a bottom layer, the second layer is a top layer, and the third layer is a middle layer, and the first and second layers are both comprised of the same material.

4. The filling product of claim 2, wherein the first layer comprises a stiffer material than the second layer.

5. The filling product of claim 1, wherein at least one of the first layer, the second layer, and the third layer has a natural resilience, such that the multi-layer strip segments each comprise a longitudinally compressed strip which is biased to longitudinally expand.

6. The filling product of claim 5, wherein the first layer has a different resilience than the third layer.

7. The filling product of claim 1, wherein the multi-layer strip segments have a transverse width dimension, and the planar portions each have a length dimension extending between adjacent folds, such that each of the planar portion length dimensions is greater than the segment width dimension.

8. The filling product of claim 7, wherein a majority of the planar portion length dimensions is less than twice the segment width dimension.

* * * * *